United States Patent [19]

MacLeod

[11] Patent Number: 4,615,199

[45] Date of Patent: Oct. 7, 1986

[54] STRIP BENDING

[75] Inventor: Colin J. MacLeod, Bearsden, Scotland

[73] Assignee: Caledonian Mining Co. Ltd., Great Britain

[21] Appl. No.: 796,882

[22] Filed: Nov. 12, 1985

[30] Foreign Application Priority Data

Nov. 16, 1984 [GB] United Kingdom ..... 8428996

[51] Int. Cl.[4] ..... B21D 5/14

[52] U.S. Cl. ..... 72/170; 72/166

[58] Field of Search ..... 72/166, 170, 173, 174; 29/149.56

[56] References Cited

U.S. PATENT DOCUMENTS 2,390,274 12/1945 Rose ..... 72/170

2,717,625 7/1955 Johnson ..... 72/166

3,842,473 10/1974 Couper ..... 72/166

*Primary Examiner*—Leon Gilden

*Attorney, Agent, or Firm*—Wood, Herron & Evans

[57] ABSTRACT

A strip metal bending machine for bending formed strip material having for example an "I" section or a "U" section, said machine comprising a plurality of rolls arranged to act on the strip along a roll path so as to bend the strip, a first roll being provided with a pair of restraining means, each restraining means located either side of the roll path so that the strip is enclosed at a bending point between the restraining means and a contact surface of said first roll, said restraining means acting on the strip in a direction substantially at right angles to the direction of action of said contact surface of said first roll, means enabling continuous restraining adjustment of one restraining means relative the other of the pair during rolling action and control means for controlling said adjustment means.

Such a machine enables material to be bent in a single pass with minimal or no twisting.

8 Claims, 5 Drawing Figures

STRIP BENDING

Figure 1:
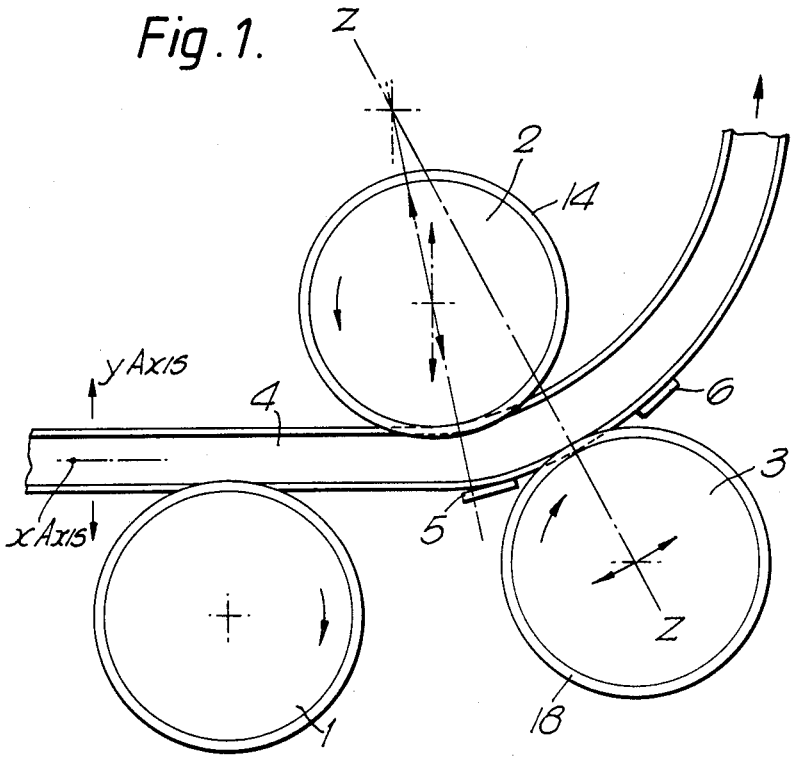

The present invention relates to apparatus for and a method of bending strip metal material such as "I" section beams and "U" section beams or other formed sections.

In order to bend such sections it is conventional to provide three rolls which straddle the feed path of the material to be bent. The first roll normally has a fixed axis on one side of the path, the next or second along the path is on the other side, whilst the third roll is on the same side of the path as the first, the second and third rolls have axes which are adjustable with respect to the bending path. Bending is gradual, that is the position of the second and third rolls is initially only slightly away from the straight feed line of the material. In order to progress the band, the material is passed through the rolls several times. Each time the positions of the second and third rolls are adjusted to increase the bend. As the bend increases the tendency for the material to twist increases. To prevent twisting the rolls are provided with flanges which should be in contact with the material on both edges. The flanges are normally adjustable to provide for different material widths. In the conventional bending method after each pass of the material, the material expands on the inside of the curvature and contracts on the outside so that to maintain contact on both edges the flanges have to be reset. This is manually done by tightening a nut on the roll shaft.

The necessity for repassing the material with manual readjustment of the flanges after each pass is time-consuming and is very much an ad hoc procedure which relies considerably on the operator's skill to achieve an accurately formed finished article which does not have a twist in it.

A bending machine according to the invention comprises a plurality of rolls at least one of which and preferably at least two of which is/are provided with a pair of restraining means, preferably flanges, the restraining means being provided with adjustment means enabling continuous adjustment with respect to each other during rolling action, and control means for controlling the adjustment means.

A method of bending strip material according to the invention comprises passing the strip material between a plurality of rolls at least one of which and preferably at least two of which is/are provided with restraining means, preferably flanges, which are adjustable with respect to each other, and continuously adjusting said restraining means during the bending action.

By reason of the provision of continuous adjustment of the restraining means it is possible to bend the material in a single pass especially if the amount of the bend is continually monitored. Furthermore it is also possible to ensure that the control means is operated so as to ensure an even and correct restraining pressure on the material so as to ensure accurate bending without any twisting being evident. A further advantage is that in a repetitive operation where material guage differs slightly from strip to strip the restraining means can be immediately reset to the correct restraining pressure normally about 10% of the roll pressure.

In a preferred embodiment of the invention the pair of restraining means comprises a pair of flanges on one of the rolls interconnected by one or more counter threaded shafts, each flange has a threaded portion counter to the other so that rotation of the or each counter threaded shaft relative the roll causes the flanges to move in unison towards or away from each other. In the case of a roll positioned on the inside of the bend the flanges should be controlled to move apart from each other as the bend increases whilst a roll on the outside of the bend is provided with similar flanges which are controlled to move towards each other as the bend increases. In such a case it will be appreciated that the roll axes are continuously moved to achieve the bending.

Figure 2:
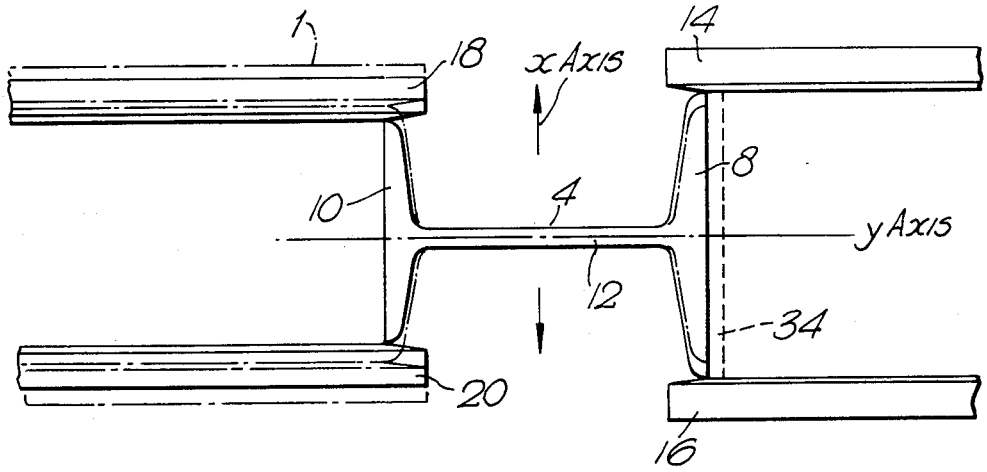
Figure 3:
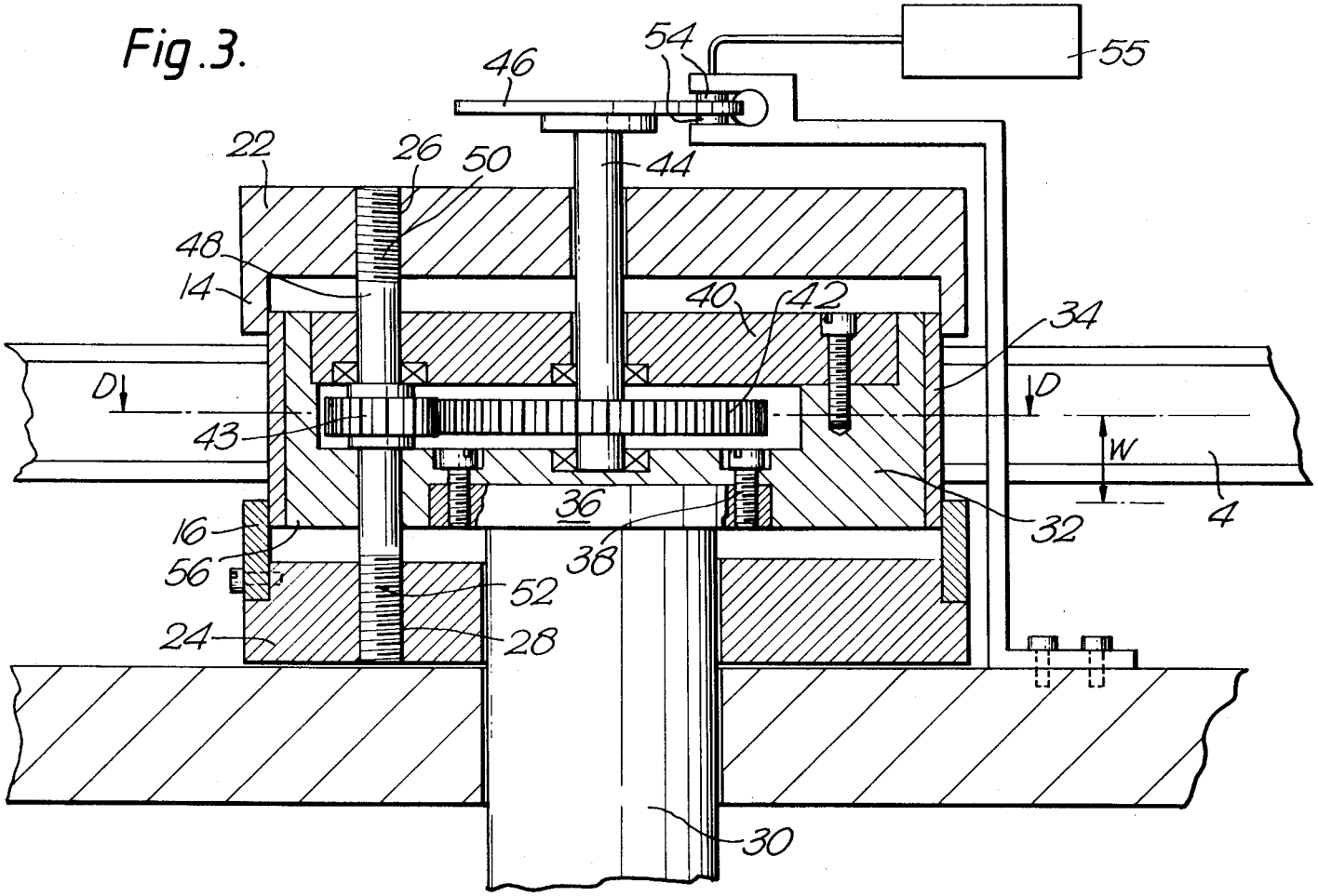
Figure 4:
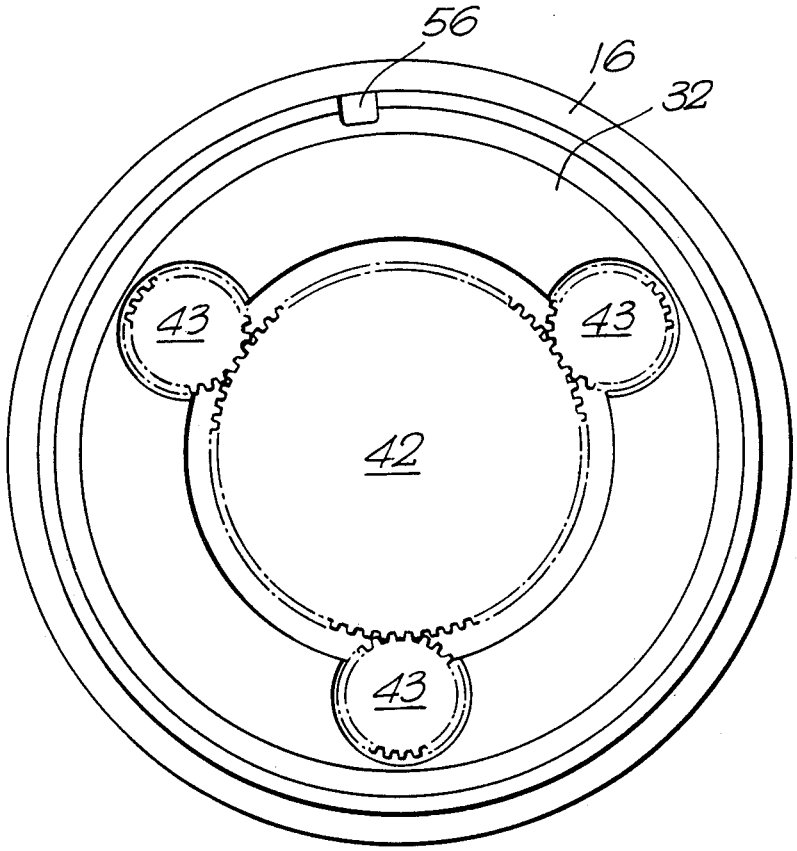
Figure 5:
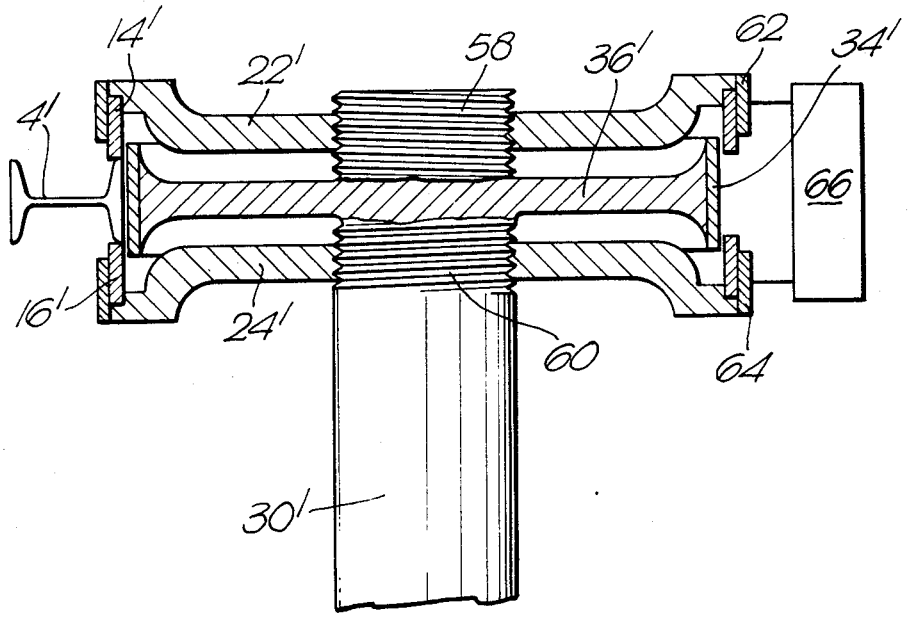

An embodiment of the invention will now be described by way of example with references to the accompanying drawings in which:

FIG. 1 is an axial view of a typical three roll bending machine layout incorporating the invention, and showing an "I" section beam being rolled to form a colliery arch, FIG. 2 is a cross section taken along the line Z—Z in FIG. 1 showing flange movement between two opposed rolls with the "I" section beam in between, FIG. 3 is a diagrammatic cross section of one of the rolls of FIG. 1 showing flange control arrangements, FIG. 4 is a diagram of part of the flange control arrangements taken at D—D in FIG. 3, and FIG. 5 is a diagram of an alternative arrangement for roll flange control according to the invention.

In FIG. 1 the typical three roll bending machine layout is shown but it should be clear that the invention is in no way restricted to such a layout. The rolls in the direction of movement of the strip material—in this case an "I" section beam 4 are first roll 1 on the outside of the beam path, second roll 2 on the inside of the bend, and third roll 3 on the outside of the bend path. For the purpose of this explanation roll 1 has a fixed axis, though it can of course be made to be movable if required. The axes of rolls 2 and 3 are movable relative each other and roll 1 whilst setting up the bend and during the bending operation. Their movement is controlled by a computer numerical control device (CNC) which is not the particular subject of the present invention though it may be associated with the control arrangements of the embodiments of the invention. Detectors 5 and 6 suitably monitor the position of the material being bent and these are linked to the CNC device.

As the material of beam 4 enters the bend between rolls 2 and 3 the inner flange 8 begins to deform in the x axis (see FIG. 2). In order to contain this x axis deformation sufficiently to prevent beam twisting, flanges 14 and 16 of roll 2 are allowed to move outwardly under control as will be described. At the same time the out flange 10 of the beam tends to retract in the x axis so that flanges 18 and 20 of roll 3 must be moved inwardly under control.

In FIGS. 3 and 4 the control arrangements for 2 (similar to those for roll 3 and even those for roll 1 if required) are shown. Flanges 14 and 16 made of hardened steel are screwed to plates 22 and 24 respectively. Plate 22 has three (or there may be more) holes 26 axially parallel to the axis of the main roll drive shaft 30. Holes 26 are threaded with a left hand thread. Plate 24 has holes 28 axially aligned with holes 26 and are threaded with a right hand thread. Between plates 22 and 24 is a main roll member 32 having a hardened steel tyre 34 which in use abutts the material to be bent. Member 32 is bolted to an end flange 36 of shaft 30 by bolts 38. A capping plate 40 is bolted to the opposite side of members 32. Between the capping plate 40 and member 32 are located a sun wheel 42 and coacting planet gears 43. Wheel 42 is fixed to a shaft 44 born in suitable bearings in the member 32 and plate 40 and extending through plate 40 and plate 22 to a brake disc 46. Gears 43 have suitable bearings in member 32 and plate 40 and extending through both to left handed and right handed threaded portions 50 and 52 corresponding to those in holes 26 and 28 respectively. Rotation of shaft 44 relative to shaft 30 causes rotation of wheel 42 and gears 43 causing the rotation of shafts 48 in plates 22 and 24 to close or open flanges 14 and 16 on workpiece 4.

To control the relative movement of shafts 44 and 30 it is merely necessary to apply a braking torque by means of brake pads 54 to disc 46. The threads in holes and shafts 26, 28, 48 are such that counterclockwise movement of roll 2 as seen in FIG. 1 with braking torque tends to open the flanges 14 and 16 whilst a similar arrangement with clockwise movement of roll 3 tends to close flanges 18 and 20. To open the flanges it is merely necessary to apply the brake hard and reverse the rolls.

The torque can be applied to shaft 44 by an alternative arrangement i.e. a torque motor mounted to plate 22.

It will be appreciated that the braking force applicable to disc 46 will be proportioned to the restraining force of flanges 14 and 16 on the workpiece and this can be easily controlled by suitable servo mechanisms controlled in turn by the main control means 55 which may be the main CNC device.

In the mechanically most advantageous arrangement the main roll member 32 requires to be as near as possible centrally located with respect to flange 36. For simplicity they are shown distanced by distance W. When W=0 the couple between 36 and 32 is reduced to zero.

A slot 56 is provided in member 32 (FIG. 4) to enable easy cutting away of tyre 34. A new tyre can then be shrunk on.

An alternative arrangement is shown in FIG. 5 where the main shaft 30' has a rolling flange 36' on which is heat shrunk a tyre 34'. Threaded portions 58 and 60 with left handed and right handed threads are provided either ride on the main shaft. Screwed on the threaded portions are flange plate 22' and 24' with flanges 14' and 16'. Screwing toward or away from each other is controlled by a pair of shoe or band brakes 62 and 64 controlled by a common servo system 66. The operation in similar to the previous embodiment.

I claim:

1. A strip metal bending machine for bending formed strip material having for example an "I" section or a "U" section, said machine comprising a plurality of rolls arranged to act on the strip along a roll path so as to bend the strip, at least a first one of the rolls being provided with a pair of restraining means, each restraining means located either side of the roll path so that the strip is enclosed at a bending point between the restraining means and a contact surface of said first roll, said restraining means acting on the strip in a direction substantially at right angles to the direction of action of said contact surface of said first roll, means enabling continuous restraining adjustment of one restraining means relative the other of the pair during rolling action and control means for controlling said adjustment means.

2. A machine as claimed in claim 1 wherein said pair of restraining means comprises a pair of flanges on said first roll interconnected by at least one counter threaded shaft, each flange having a threaded portion engaged with the counter threaded shaft, the threaded portion of one flange of a pair being counter threaded with respect the threaded portion of the other flange of the pair so that rotation of the shaft relative the roll causes flanges of the pair to move in unison towards or away from each other.

3. A machine as claimed in claim 1 wherein said pair of restraining means comprises a pair of flanges on said first roll threadingly mounted on counter threaded portions of a drive shaft drivably connected to said first roll, one threaded portion being counter in direction to the other threaded portion, braking means arranged to brake said flanges to cause differential motion between the flanges and the drive shaft whereby rotation of the drive shaft with braking on the flanges causes the flanges of the pair to move in unison towards or away from each other.

4. A machine according to claim 1 having at least a first and a second roll each provided with a pair of said restraining means, one said roll positioned adjacent the bending point on the outside of the roll path and the other said roll positioned adjacent the bending point on the inside of the roll path, said pairs of flanges being so controlled that the flanges of the roll on the inside of the bend move apart from each other as the bend increases whilst the flanges of the roll on the outside of the bend are controlled to move towards each other as the bend increases.

5. A machine as claimed in claim 2 wherein the or each counter threaded shaft is geared to a brake shaft coaxial with a drive shaft drivably connected to said roll, and braking means on said brake shaft controlled by said control means.

6. A machine according to claim 1 wherein detectors detecting the angle of bend are provided either side of the contact surface of said roll.

7. A method of bending strip material having for example an "I" section or a "U" section, comprising passing said strip material along a curvilinear roll path between a plurality of rolls at least one of which is provided with a pair of restraining means acting in a first direction substantially at right angles to a second direction being the direction of bending action of said one roll on said strip, said restraining means being continuously adjusted in said first direction during movement of the said strip material between said rolls.

8. A method of bending strip material as claimed in claim 7 comprising moving a pair of said restraining means away from each other and from the strip on the inside of the curvilinear roll path as the bend increases whilst moving a pair of said restraining means towards each other onto the strip onto the outside of the roll path as the bend increases.

* * * * *